US005549738A

United States Patent [19]

Kitada et al.

[11] Patent Number: 5,549,738

[45] Date of Patent: Aug. 27, 1996

[54] PLATINUM ELECTROFORMING BATH

[75] Inventors: Katsutsugu Kitada; Soumei Yarita, both of Kanagawa-ken, Japan

[73] Assignee: Electroplating Engineers of Japan, Limited, Japan

[21] Appl. No.: 237,693

[22] Filed: May 4, 1994

Related U.S. Application Data

[63] Continuation of Ser. No. 718,767, Jun. 21, 1991, Pat. No. 5,310,475.

[30] Foreign Application Priority Data

| | | | |
|---|---|---|---|
| Jun. 29, 1990 | [JP] | Japan | 2-170064 |
| Jul. 16, 1990 | [JP] | Japan | 2-185241 |
| Apr. 30, 1991 | [JP] | Japan | 3-124577 |
| Apr. 30, 1991 | [JP] | Japan | 3-124578 |
| Apr. 30, 1991 | [JP] | Japan | 3-124579 |

[51] Int. Cl.[6] ..... C25D 3/52

[52] U.S. Cl. ..... 106/1.21; 205/264

[58] Field of Search ..... 205/264; 106/1.21

[56] References Cited

U.S. PATENT DOCUMENTS 1,901,531 3/1933 Powell et al. ..... 205/264

OTHER PUBLICATIONS

Davies et al, "Platinum Plating from Alkaline Solutions", Intern. Electrodep. Conf., 1937, advance copy.

Indira et al, "Addition Agent for Platinum Plating", Metal Finishing, May 1969, pp. 44–49.

*Primary Examiner*—John Niebling

*Assistant Examiner*—Kishor Mayekar

*Attorney, Agent, or Firm*—Klauber & Jackson

[57] ABSTRACT

The invention relates to platinum electroforming and platinum electroplating capable of preparing a deposited platinum material having high hardness and increased thickness and size. The platinum electroforming or electroplating bath comprises at least one compound selected from the group consisting of chloroplatinic acid, chloroplatinates of alkali metals, hydrogen hexahydroxoplatinate, and hexahydroxoplatinates of alkali metals, 2–100 g/l as platinum and a hydroxylated alkali metal, 20–100 g/l.

2 Claims, No Drawings

PLATINUM ELECTROFORMING BATH

RELATED APPLICATIONS

This application is a continuation of application Ser. No. 07/718,767, filed Jun. 21, 1991, now U.S. Pat. No. 5,310,475, to be issued May 10, 1994.

BACKGROUND OF THE INVENTION

1. Field of the Invention

The present invention relates to a platinum electroforming and also to a platinum electroplating.

Platinum has widely been used as ornaments or accessories because of its clean and subdued shine, although it has a less loud color than gold. Platinum is also highly resistant to corrosion and gives a catalytic effect, and thus it can be adopted as materials for products used in industries.

Platinum, however, has an inherent tenacity, which brings about a decreased workability of platinum. A high degree of technical skill of a professional workman is imperative especially for the working of accessories such as earrings or brooches which requires elaborate workmanship for the manufacture.

Furthermore, inasmuch as the specific gravity of platinum is higher, for example, than that of white gold made of an alloy of gold and silver, it cannot be made into a large-sized accessories as put on a personal body. There have been limitations on the size of such commercial platinum products.

For these reasons, the present inventor has undertaken studies pertinent to a platinum electroforming method to solve the above-mentioned problems i.e., the limitations on workability and size. Specifically, these studies have been directed to a method including the stages of forming by means of electrodeposition a thick deposition layer of platinum on the surface of a mother die to which a release coat has been applied and releasing the deposited layer from the mother die to obtain an electroformed product of platinum having opposite convex and concave surfaces to those of the mother die. Adding to these stages the method may include the stages of applying a release coat to the surface of the resultant electroformed product and treating by means of electrodeposition to obtain a product of platinum having the same convex and concave surfaces as those of the mother die. If the electroforming method may be materialized, it may simultaneously solve the problems such as the deficient workability and the limitation on size of platinum as aforementioned since it allows to conveniently prepare hollow products of platinum or products with a film of any thickness of platinum.

2. Description of the Prior Art

From the above reasons, there has been a great demand for the electroforming of platinum. In fact, various studies on the electroforming of platinum have been conducted. However, no successful process has been completed so far.

This is because a thickness of a deposited layer to be required in the electroforming is about 10–50 times as large as usual electroplating (for example, Japanese Patent Laid-open Publication No. 107,794/1990). Specifically, one will fail to prepare the deposited layer of such a thickness because deposited platinum has a tendency to occlude hydrogen, which increases an internal stress of the deposited layer, resulting in generation of cracks (micro crevices). Thus, one can not obtain the desirable deposited layer having sufficient strength and thickness to be used for commercial products. In particular, special consideration must be given to physical and mechanical properties of the deposited layer, since the deposited layer per se becomes a product of electroforming. The generation of cracks may therefore cause fatal problems to the electroformed products.

In addition, a general platinum metal, which is not a deposited metal prepared by electroforming or electroplating, has a crystal structure of face centered cubic lattice. Also, it is soft (approximately 40 Hv) and ductile. However, ornaments, e.g. rings, necklaces made of platinum having these characteristics possess the drawbacks of being easily scratched and deformed because they are soft and abradable.

Because of these reasons, platinum is conventionally alloyed with other metals to increase hardness for manufacturing ornaments using platinum. This method, though it allows the hardness of the platinum alloy to increase, however, causes generation of intermetallic compounds in the platinum alloy to result in brittleness of the platinum alloy. The method has also the disadvantage of generation of an oxide film in the steps of heating or brazing a platinum alloy, thereby reducing the external quality of the platinum alloy.

In view of this situation, it has been desired to develop means other than these alloying methods to improve the hardness of a platinum alloy.

SUMMARY OF THE INVENTION

One of the objects of the present invention is to provide a platinum electroforming bath capable of producing a platinum deposit having a considerable strength and thickness.

It is another object of the present invention to provide a method for preparing a platinum material having high hardness by adopting electrodeposition from a platinum electrolytic bath (platinum electroforming or electroplating bath) as means for improving the hardness of platinum.

Other objects, features and advantages of the invention will hereinafter become more readily apparent from the following description.

DESCRIPTION OF PREFERRED EMBODIMENTS

The platinum electroforming or plating bath according to the present invention comprises:

at least one compound selected from the group consisting of chloroplatinic acid, chloroplatinates of alkali metals, hydrogen hexahydroxoplatinate, and hexahydroxoplatinates of alkali metals, 2–100 g/l as platinum; and a hydroxylated alkali metal, 20–100 g/l.

As a salt of platinum, chloroplatinic acid [$H_2PtCl_6$] or hydrogen hexahydroxoplatinate [$H_2Pt(OH)_6$] is preferable. Their salts of alkali metals are also preferable. Among these salts, sodium chloroplatinate [$Na_2PtCl_6$], potassium chloroplatinate [$K_2PtCl_6$], and the like are preferable as the chloroplatinate of alkali metals, and sodium hexahydroxoplatinate [$Na_2Pt(OH)_6.2H_2O$], potassium hexahydroxoplatinate [$K_2Pt(OH)_6$], and the like are preferable as the hexahydroxoplatinate of alkali metals. A preferable amount of these platinum salts to be incorporated is 2–100 g/l as platinum.

Preferable examples of the hydroxylated alkali metals are potassium hydroxide and sodium hydroxide. The hydroxylated alkali metal is incorporated in order to dissolve platinum, preferably, in an amount of 20–100 g/l.

Given as examples of preferable soluble carboxylate are potassium or sodium salts of acetic acid, oxalic acid, citric acid, malic acid, propionic acid, lactic acid, malonic acid, tartaric acid, and the like. Preferable examples of the phosphate are potassium phosphate, sodium phosphate, dipotassium hydrogenphosphate, disodium hydrogenphosphate, potassium hydrogenphosphate, sodium hydrogenphosphate, and the like. As the sulfate, potassium sulfate, sodium sulfate, and the like are preferable.

Such a soluble calboxylate or the like acts as a stabilizer in the electroforming or plating bath. It is preferably incorporated in an amount of 2–200 g/l.

In addition to the above components, the electroforming or plating bath of platinum may include additives such as various brightening agents, electroconductive salts, and the like.

Additionally, a platinum alloy can be deposited by incorporating other metal salts in the electroforming or plating bath. Preferable examples of metals adapted to make an alloy with platinum are gold, silver, palladium, iridium, ruthenium, cobalt, nickel, copper, and the like. The number of other metals being incorporated is not restricted to one. Two kinds of metals can be incorporated to make an alloy with platinum, for example, an alloy of platinum-palladium-copper.

A preferable operating temperature for the electroforming or plating bath is not lower than 65° C., with the temperature of not lower than 80° C. being particularly preferable. Generally, a current density is preferably 1–3 ASD, when platinum is contained in the amount of 20 g/l, though it depends on plating conditions.

A platinum metal produced by means of electrodeposition from the platinum electrolytic bath has a reduced crystal size. The platinum metal has also a hardness of at least 100–350 Hv. Such hardness is greatly higher than that of a platinum metal, i.e. about 40 Hv, prepared by general melting procedures.

There is the following relationship between the purity and hardness of the platinum material prepared by the method of the present invention:

| Purity (wt %) | Hardness |
|---|---|
| 99.9 | Above 100 $H_v$ |
| 95.0–99.9 | Above 200 $H_v$ |
| 90.0–95.0 | Above 250 $H_v$ |
| 85.0–90.0 | Above 300 $H_v$ |

Microscopic and macroscopic stresses are involved in the platinum metal obtained by means of electrodeposition. The microscopic stress which is a non-uniformed stress corresponding to an expanded width of X-ray diffraction lines causes the increased hardness of the deposited metal. While the macroscopic stress is a residual tensile or compressive stress involved in the deposited platinum metal and makes a cause of strain or cracks. The macroscopic stress of platinum is very large. The macroscopic stress, however, can be restrained by adopting an alkaline platinum electrolytic bath or by annealing (heat treatment) for each additional thickness of about 5–10 μm of a deposited layer. The annealing is performed under heating, preferably, at 400°–900° C. for 30–120 min. By the annealing, the hardness of the platinum metal may be reduced. Such degree of the reduced hardness is nevertheless higher than that of conventional platinum metals. Accordingly, the deposited layer having sufficiently large thickness and size can be provided, and thus platinum products having high hardness can be manufactured by means of, namely, the electroforming.

As a platinum electrolytic bath when adopting a means of platinum electroforming or electroplating to improve the hardness of platinum, an alkaline bath is very advantageous from the aspect of deposition efficiency, a macroscopic stress, and the like. In this respect, the platinum electrolytic bath includes one or more platinum compounds selected from the group consisting of tetrachloroplatinate, hexachloroplatinate, tetrabromoplatinate, hexabromoplatinate, hexahydroxoplatinate, diamminedinitroplatinum, tetranitroplatinate, and the like; and one or more compounds selected from the group consisting of hydroxylated alkali metals, ammonia, conductive salts, and the like, and, as required, may include alloying metal salts.

Stated additionally, the annealing is not necessary when using as the platinum electrolytic bath the previously mentioned composition comprising:

at least one compound selected from the group consisting of chloroplatinic acid, chloroplatinates of alkali metals, hydrogen hexahydroxoplatinate, and hexahydroxoplatinates of alkali metals, 2–100 g/l as platinum; and a hydroxylated alkali metal, 20–100 g/l.

Other features of the invention will become apparent in the course of the following description of the exemplary embodiments which are given for illustration of the invention and are not intended to be limiting thereof.

EXAMPLES

Example 1

A preferable example of the electroforming of the present invention is herein illustrated.

TABLE 1

(Composition of a platinum electroforming bath)

| | |
|---|---|
| Hydrogen hexahydroxoplatinate $[H_2Pt(OH)_6]$ | 30 g/l |
| Potassium acetate $[KCH_3CO_2]$ | 40 g/l |
| Potassium hydroxide [KOH] | 60 g/l |

pH: 13.5

A test was performed using the above electroforming bath shown in Table 1 under the different conditions with respect to the time and the current density to deposit a deposition layer of platinum on the surface of a test piece of brass.

The results are shown in Table 2. The deposition layers obtained all exhibited an excellently glossy appearance. Observation under microscope showed no existence of cracks. Further, the deposition layers had an increased thickness in proportion to the electroforming time. These results demonstrate that the bath can be used as an electroforming bath. Accordingly, light and large-sized earrings or brooches with a hollow construction can be produced by the method using the electroforming bath of the present invention. Also, elaborate works can be achieved without using high technical skill.

TABLE 2

| No. | Electro-Forming min | Current Density ASD | Deposition Efficiency mg/A · min | Thickness of Deposition μm |
|---|---|---|---|---|
| 1 | 4 | 3 | 29.3 | 1.64 |
| 2 | 4 | 3 | 29.6 | 1.66 |
| 3 | 60 | 3 | 29.6 | 24.8 |
| 4 | 153 | 2 | 29.2 | 41.7 |
| 5 | 240 | 2 | 29.3 | 65.6 |
| 6 | 265 | 2 | 29.5 | 72.9 |
| 7 | 180 | 3 | 29.4 | 74.0 |
| 8 | 480 | 2.3 | 29.5 | 150 |

Example 2

In this example, an experiment of producing an insoluble platinum electrode was performed by plating platinum on titanium. A plating bath having the same composition as that of the electroforming bath shown in Table 1 was used in this example. The plating was carried out using this plating bath under the following operating conditions.

Plating method: dip plating

Bath temperature: 80° C.

Current density: 3 ASD

Plating time: 10 min

Inspection of the insoluble platinum electrode obtained revealed that an adhesive platinum layer having a glossy surface with a thickness of 4 μm was formed. The surface of the platinum layer was observed under a microscope to show that any pin hole or crack did not occur. It was confirmed that a uniform current distribution could be obtained when this insoluble platinum electrode was used as an electrode in practice and also that the platinum layer on the surface of the electrode was never peeled off from titanium which was a metal underneath over a prolonged period of time.

The platinum plating according to the present invention, however, is not restricted to use in a field of the above insoluble platinum electrode, but can be applied to, for example, the formation of a platinum layer on a heat resisting section of a jet turbine.

Example 3

Electroforming was carried out using the electrolytic baths No. 1–11 having the compositions and conditions as tabulated below to deposit platinum on a test piece of brass, while deposited layers were annealed during the above procedures when their microscopic stresses were high. The deposited layers (platinum material) obtained had high hardness, the surface thereof being smooth. Also, the flexibility of the deposited layer stood comparison with that of ordinary platinum.

Electrolytic Bath No.1

| | |
|---|---|
| Composition | |
| Pt [as $Pt(NH_3)_2(NO_2)_2$] | 10 g/l |
| $C_5H_5N$ | 200 ml/l |
| $NH_3$ | 100 ml/l |
| Condition | |
| pH | 13 (adjusted by NaOH) |
| Temperature | 75° C. |
| Current density | 1.0 A/dm$^2$ |
| Deposition efficiency | 45 mg/A · min |
| Electrolytic time | 240 min |
| Deposited layer | |
| Thickness | 48 μm |
| Purity | 99.95 wt % |
| Hardness | 270 $H_v$ |

Electrolytic Bath No.2

| | |
|---|---|
| Composition | |
| Pt [as $Pt(NH_3)_2(NO_2)_2$] | 10 g/l |
| $C_5H_5N$ | 200 ml/l |
| $NH_3$ | 100 ml/l |
| $CuSO_4.5H_2O$ | 1.97 g/l |
| Condition | |
| pH | 11 |
| Temperature | 65° C. |
| Current density | 1.0 A/dm$^2$ |
| Deposition efficiency | 30.4 mg/A · min |
| Electrolytic time | 360 min |
| Deposited layer | |
| Thickness | 48 μm |
| Purity | 99.97 wt % |
| Hardness | 330 $H_v$ |

Electrolytic Bath No.3

| | |
|---|---|
| Composition | |
| Pt [as $K_2PtCl_4$] | 10 g/l |
| EDTA-2Na | 80 g/l |
| Condition | |
| pH | 6 |
| Temperature | 70° C. |
| Current density | 1.0 A/dm$^2$ |
| Deposition efficiency | 10.0 mg/A · min |
| Electrolytic time | 480 min |
| Deposited layer | |
| Thickness | 16 μm |
| Purity | 99.94 wt % |
| Hardness | 283 $H_v$ |

Electrolytic Bath No.4

| | |
|---|---|
| Composition | |
| Pt [as $K_2[pt(NO_2)_4]$] | 10 g/l |
| $K_2HPO_3$ | 0.5 mol/l |
| $KNO_3$ | 0.2 mol/l |
| Condition | |
| pH | 13 (adjusted by NaOH) |
| Temperature | 60° C. |
| Current density | 1.0 A/dm$^2$ |
| Deposition efficiency | 9.4 mg/A · min |
| Electrolytic time | 480 min |
| Deposited layer | |
| Thickness | 16 μm |
| Purity | 99.97 wt % |
| Hardness | 420 $H_v$ |

Electrolytic Bath No.5

| Composition | |
|---|---|
| Pt [as $H_2Pt(OH)_6$] | 13 g/l |
| $CH_3COONa$ | 0.5 mol/l |
| EDTA-4H | 0.05 mol/l |
| NaOH | 40 g/l |
| $NiSO_4.6H_2O$ | 0.04 mol/l |
| **Condition** | |
| pH | 13 |
| Temperature | 65° C. |
| Current density | 1.0 A/dm$^2$ |
| Deposition efficiency | 31.0 mg/A · min |
| Electrolytic time | 360 min |
| **Deposited layer** | |
| Thickness | 48 μm |
| Purity | 96.2 wt % |
| Hardness | 440 $H_v$ |

Electrolytic bath No.6

| Composition | |
|---|---|
| Pt [as $H_2Pt(OH)_6$] | 13 g/l |
| $CH_3COONa$ | 0.5 mol/l |
| EDTA-4H | 0.05 mol/l |
| NaOH | 40 g/l |
| $NiSO_4.6H_2O$ | 0.04 mol/l |
| **Condition** | |
| pH | 13 |
| Temperature | 65° C. |
| Current density | 1.0 A/dm$^2$ |
| Deposition efficiency | 31.0 mg/A · min |
| Electrolytic time | 180 min |
| **Deposited layer** | |
| Thickness | 14 μm |
| Purity | 97.0 wt % |
| Hardness | 450 $H_v$ |

Electrolytic Bath No.7

| Composition | |
|---|---|
| Pt [as $H_2Pt(OH)_6$] | 20 g/l |
| KOH | 50 g/l |
| $K_2C_2O_4.H_2O$ | 30 g/l |
| **Condition** | |
| pH | 13.5 |
| Temperature | 90° C. |
| Current density | 3 A/dm$^2$ |
| Deposition efficiency | 30 mg/A · min |
| Electrolytic time | 240 min |
| **Deposited layer** | |
| Thickness | 100 μm |
| Purity | 99.9 wt % |
| Hardness | 350 $H_v$ |

Electrolytic Bath No.8

| Composition | |
|---|---|
| Pt [as $H_2Pt(OH)_6$] | 20 g/l |
| KOH | 40 g/l |
| Sn [as $K_2SnO_3.3H_2O$] | 30 g/l |
| Potassium tartrate.½$H_2O$ | 100 g/l |

-continued

| Condition | |
|---|---|
| pH | 13.3 |
| Temperature | 90° C. |
| Current density | 2 A/dm$^2$ |
| Deposition efficiency | 20 mg/A · min |
| Electrolytic time | 300 min |
| **Deposited layer** | |
| Thickness | 60 μm |
| Purity | 85 wt % |
| Hardness | 650 $H_v$ |

Electrolytic Bath No.9

| Composition | |
|---|---|
| Pt [as $H_2Pt(OH)_6$] | 20 g/l |
| KOH | 100 g/l |
| Zn [as ZnO] | 0.8 g/l |
| **Condition** | |
| pH | 14 |
| Temperature | 90° C. |
| Current density | 2 A/dm$^2$ |
| Deposition efficiency | 30 mg/A · min |
| Electrolytic time | 180 min |
| **Deposited layer** | |
| Thickness | 50 μm |
| Purity | 95 wt % |
| Hardness | 450 $H_v$ |

Electrolytic Bath No.10

| Composition | |
|---|---|
| Pt [as $H_2PtCl_6$] | 10 g/l |
| $C_5H_5N$ | 200 ml/l |
| $NH_3$ | 100 ml/l |
| $Na_2CO_3$ | 0.1 mol/l |
| Pd [as cis-$Pd(NH_3)_2(NO_2)_2$] | 1 g/l |
| **Condition** | |
| pH | 12 (adjusted by NaOH) |
| Temperature | 75° C. |
| Current density | 1.0 A/dm$^2$ |
| Deposition efficiency | 32.2 mg/A · min |
| Electrolytic time | 180 min |
| **Deposited layer** | |
| Thickness | 25 μm |
| Purity | 85.6 wt % |
| Hardness | 505 $H_v$ |

Electrolytic Bath No.11

| Composition | |
|---|---|
| Pt (as $H_2PtCl_6$] | 10 g/l |
| $C_5H_5N$ | 200 ml/l |
| $NH_3$ | 100 ml/l |
| $Na_2CO_3$ | 0.1 mol/l |
| Pd [as cis-$Pd(NH_3)_2(NO_2)_2$] | 1 g/l |
| **Condition** | |
| pH | 12 (adjusted by NaOH) |

-continued

| | |
|---|---|
| Temperature | 75° C. |
| Current density | 1.0 A/dm$^2$ |
| Deposition efficiency | 32.2 mg/A · min |
| Electrolytic time | 360 min |
| Deposited layer | |
| Thickness | 49 μm |
| Purity | 87.0 wt % |
| Hardness | 410 $H_v$ |

What is claimed is:

1. A platinum electroforming bath consisting of a hexahydroxyplatinate of hydrogen or an alkali metal, present in an amount of 2–100 g/l; an alkali metal hydroxide, present in an amount of 20–100 g/l; and an alkali metal carboxylate, present, in an amount of 20–100 g/l.

2. The platinum electroforming bath of claim 1 consisting of $H_2Pt(OH)_6$, KOH and $K_2C_2O_4.H_2O$.

* * * * *